US008448617B2

(12) United States Patent
Clever et al.

(10) Patent No.: US 8,448,617 B2
(45) Date of Patent: May 28, 2013

(54) ENGINE INCLUDING CAMSHAFT WITH PARTIAL LOBE

(75) Inventors: Glenn E. Clever, Washington, MI (US); Rodney K. Elnick, Washington, MI (US); Ronald Jay Pierik, Holly, MI (US)

(73) Assignee: GM Global Technology Operations LLC

( * ) Notice: Subject to any disclaimer, the term of this patent is extended or adjusted under 35 U.S.C. 154(b) by 388 days.

(21) Appl. No.: 12/908,345

(22) Filed: Oct. 20, 2010

(65) Prior Publication Data

US 2012/0097120 A1 Apr. 26, 2012

(51) Int. Cl.
*F01L 1/34* (2006.01)

(52) U.S. Cl.
USPC ..... 123/90.16; 123/90.15

(58) Field of Classification Search
USPC ..... 123/90.15, 90.16, 90.6
See application file for complete search history.

(56) References Cited

U.S. PATENT DOCUMENTS

| | | | | |
|---|---|---|---|---|
| 5,664,463 | A | 9/1997 | Amborn et al. | |
| 5,809,954 | A | 9/1998 | Devine et al. | |
| 6,725,817 | B2 | 4/2004 | Methley et al. | |
| 6,725,818 | B2 | 4/2004 | Methley | |
| 6,976,461 | B2 * | 12/2005 | Rorig et al. | 123/90.16 |
| 7,069,892 | B2 | 7/2006 | Lechner et al. | |
| 7,210,440 | B2 | 5/2007 | Lawrence et al. | |
| 7,284,517 | B2 | 10/2007 | Lancefield et al. | |
| 7,287,499 | B2 | 10/2007 | Lawrence et al. | |
| 7,431,002 | B2 | 10/2008 | Hoffmann et al. | |
| 7,444,968 | B2 | 11/2008 | Lancefield et al. | |
| 7,597,078 | B2 | 10/2009 | Kroos et al. | |
| 7,610,890 | B2 | 11/2009 | Lettmann et al. | |
| 2010/0012060 | A1 | 1/2010 | Clever et al. | |

FOREIGN PATENT DOCUMENTS

| | | | |
|---|---|---|---|
| GB | 2424257 | A | 9/2006 |

OTHER PUBLICATIONS

Lancefield, Tim et al., "VLD" a flexible, modular, cam operated VVA system giving variable valve lift and duration and controlled secondary valve openings, SIA Conference on Variable Valve Actuation—Nov. 30, 2006—IFP Rueil, 10 pages.

* cited by examiner

*Primary Examiner* — Zelalem Eshete
(74) *Attorney, Agent, or Firm* — Harness, Dickey & Pierce, P.L.C.

(57) ABSTRACT

An engine assembly may include a camshaft rotationally supported on an engine structure. The camshaft may include a first shaft, a second shaft located in and rotatable relative to the first shaft and a partial cam lobe located on the first shaft. The partial cam lobe may include a peak region and may define a partial bore. A radial distance defined by the partial bore between first and second circumferential ends of the partial bore may be greater than or equal to a radial width of the first shaft. The partial cam lobe may define a recess extending in a radial direction through the partial bore and into the partial cam lobe. The camshaft may include a sleeve located within a radial passage defined by the second shaft and the recess in the partial cam lobe and radially locating the partial cam lobe relative to the second shaft.

8 Claims, 2 Drawing Sheets

ENGINE INCLUDING CAMSHAFT WITH PARTIAL LOBE

FIELD

The present disclosure relates to engine camshaft assemblies.

BACKGROUND

This section provides background information related to the present disclosure which is not necessarily prior art.

Engines typically include one or more camshafts to actuate intake and exhaust valves. The camshaft may be in the form of a concentric camshaft that provides for relative rotation between lobes on camshaft. More specifically, the camshaft may include fixed lobes with rotatable lobes located between the fixed lobes.

SUMMARY

An engine assembly may include an engine structure and a camshaft rotationally supported on the engine structure. The camshaft may include a first shaft defining an axial bore, a second shaft located in the axial bore and a first partial cam lobe located on the first shaft. The second shaft may be rotatable relative to the first shaft and may define a radial passage. The first partial cam lobe may include a first peak region and may define a partial bore having a circumferential extent from a first circumferential end of the first partial cam lobe to a second circumferential end of the first partial cam lobe. A radial distance defined by the partial bore between the first and second circumferential ends may be greater than or equal to a radial width of the first shaft. The first partial cam lobe may additionally define a first recess extending in a radial direction through the partial bore and into the first partial cam lobe. The camshaft may include a first sleeve located within the radial passage and the first recess and radially locating the first partial cam lobe relative to the second shaft.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
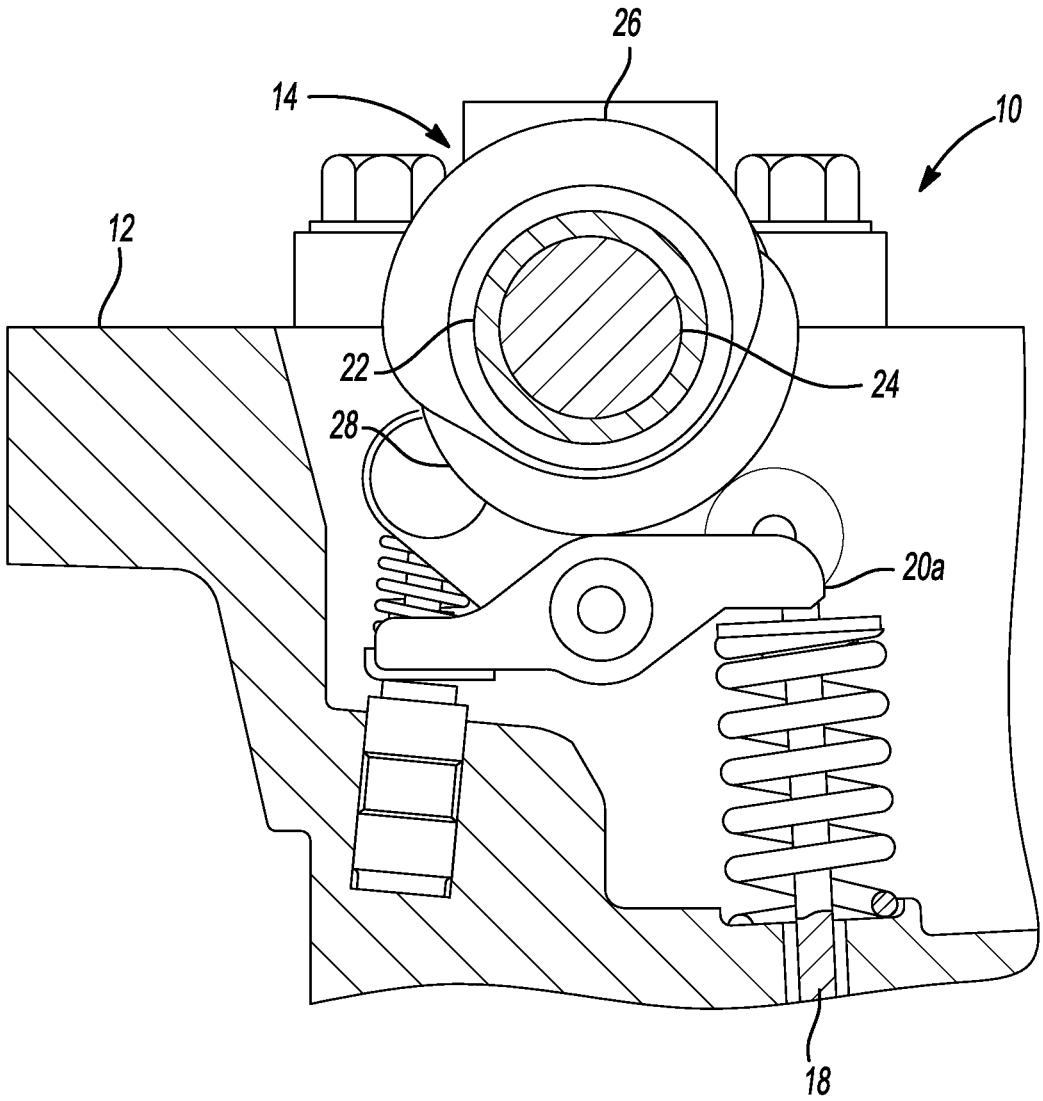
FIG. 1 is a fragmentary section view of an engine assembly according to the present disclosure.

An exemplary engine assembly 10 is schematically illustrated in FIG. 1 and may include an engine structure 12, a camshaft 14 rotationally supported on the engine structure 12, a cam phaser 16 (FIG. 2) coupled to the camshaft 14, an engine valve 18 and a first valve lift mechanism 20*a* engaged with the camshaft 14 and the engine valve 18. In the present non-limiting example, the engine assembly 10 is illustrated as an overhead camshaft engine where the engine structure 12 is a cylinder head. However, it is understood that the present disclosure is not limited to overhead camshaft arrangements and applies equally to a variety of other engine configurations as well, such as cam-in-block (or pushrod) engines. It is also understood that the engine valve 18 may be an exhaust valve or an intake valve.

Figure 2:
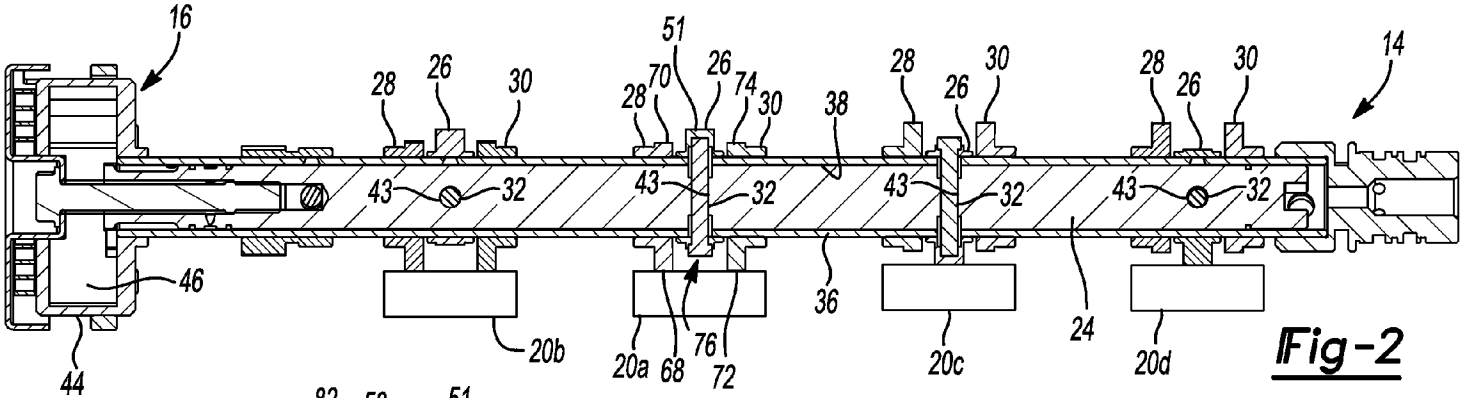
FIG. 2 is a section view of the camshaft assembly shown in the engine assembly of FIG. 1.

With additional reference to FIG. 2, the camshaft 14 may include first and second shafts 22, 24, first cam lobes 26, second cam lobes 28, third cam lobes 30, and fasteners 32. In the present non-limiting example, the first, second and third cam lobes 26, 28, 30 are all either intake lobes or exhaust lobes. However, it is understood that the present disclosure applies equally to arrangements where the first, second and third cam lobes 26, 28, 30 include a combination of both intake and exhaust lobes. Arrangements including both intake and exhaust lobes may be employed when the present disclosure is applied, for example, to cam-in-block engines.

The first shaft 22 may include an annular wall 36 defining an axial bore 38. The annular wall 36 may include first and second circumferentially extending slots 40, 42. The second shaft 24 may be located within the axial bore 38 and rotatable relative to the first shaft 22. The second shaft 24 may be a solid shaft defining a solid central region and may define radial passages 43 rotationally aligned with the first and second circumferentially extending slots 40, 42.

The cam phaser 16 may include a stator 44 coupled to the first shaft 22 and a rotor 46 coupled to the second shaft 24. The rotor 46 may rotate the second shaft 24 relative to the first shaft 22. The first cam lobes 26 may be fixed for rotation with the second shaft 24 and the second and third cam lobes 28, 30 may be fixed for rotation with the first shaft 22. For simplicity, a first set of first, second and third cam lobes 26, 28, 30 will be discussed below with the understanding that the description applies equally to the additional sets of first, second and third cam lobes 26, 28, 30 engaged with the second, third and fourth valve lift mechanisms 20*b*, 20*c*, 20*d*. The first, second, third and fourth valve lift mechanisms 20*a*, 20*b*, 20*c*, 20*d* may each form additive lift mechanisms.

Figure 3:
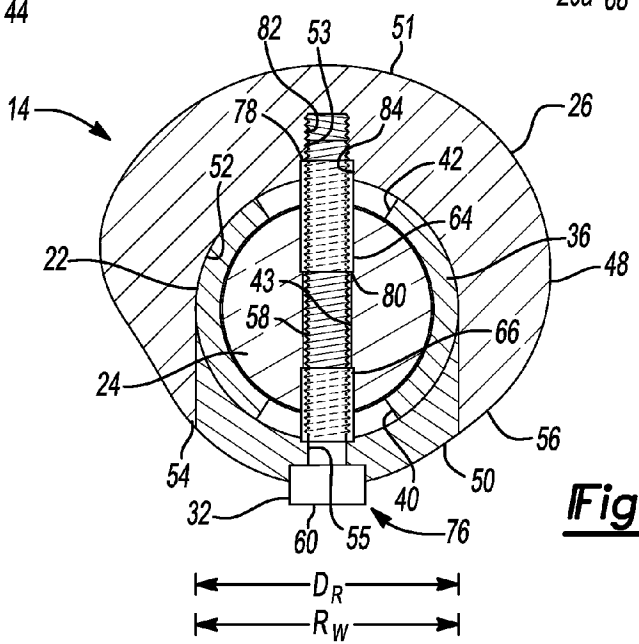
FIG. 3 is a section view of the camshaft assembly of FIG. 2.

With additional reference to FIG. 3, the first cam lobe 26 may include a first partial cam lobe 48 and a first base cam portion 50. The first partial cam lobe 48 may include a first peak region 51. The first partial cam lobe 48 may define a partial bore 52 having a circumferential extent from a first circumferential end 54 of the first partial cam lobe 48 to a second circumferential end 56 of the first partial cam lobe 48. A radial distance ($D_R$) defined by the partial bore 52 between the first circumferential end 54 and the second circumferential end 56 may be greater than or equal to a radial width ($R_W$) of the first shaft 22. By way of non-limiting example, the radial width ($R_W$) of the first shaft 22 may be the diameter of the first shaft 22 and the radial distance ($D_R$) defined by the partial bore 52 may be a diameter of the partial bore 52.

The first base cam portion 50 may be located on the first shaft 22 and axially aligned with and coupled to the first partial cam lobe 48. The first base cam portion 50 may form a base circle region (i.e., non-peak region) of the first cam lobe 26. The first partial cam lobe 48 may define a first recess 53 and the first base cam portion 50 may define a second recess 55. The first recess 53 may be threaded. The first recess 53 may extend in a radial direction through the partial bore 52 and partially into the first partial cam lobe 48. The second recess 55 may extend in a radial direction completely through the first base cam portion 50.

The fastener 32 may fix the first partial cam lobe 48 and the first base cam portion 50 to one another and the second shaft 24. The fastener 32 may extend radially through the first base cam portion 50, the first shaft 22, the second shaft 24 and into the first partial cam lobe 48. More specifically, the fastener 32 may extend radially through the second recess 55 of the first base cam portion 50, through the first circumferentially extending slot 40 in the first shaft 22, through the radial passage 43 in the second shaft 24, through the second circumferentially extending slot 42 in the first shaft 22 and into the first recess 53 in the first partial cam lobe 48.

By way of non-limiting example, the fastener 32 may include a threaded shank 58 extending from a head 60. First and second sleeves 64, 66 may be located on the threaded shank 58. The fastener 32 may be axially aligned with the first peak region 51 of the first partial cam lobe 48. The first sleeve 64 may be located in the first recess 53 of the first partial cam lobe 48, the second circumferential slot 42 in the first shaft 22 and the radial passage 43 in the second shaft 24. The first sleeve 64 may radially locate the first partial cam lobe 48 relative to the second shaft 24. The second sleeve 66 may be located in the second recess 55 of the first base cam portion 50, the first circumferential slot 40 in the first shaft 22 and the radial passage 43 in the second shaft 24.

The fastener 32 may extend through the radial passage 43 in the second shaft 24 and the first sleeve 64 and into the first recess 53 in the first partial cam lobe 48 with the head 60 abutting an outer surface of the first base cam portion 50. The radial passage 43 may define an unthreaded bore. The fastener 32 may secure the first partial cam lobe 48 and the first base cam portion 50 to one another and to the second shaft 24 for rotation with the second shaft 24. However, it is understood that a variety of other fastening arrangements may be used including, but not limited to, a fastener being press fit into the first recess 53.

The second cam lobe 28 may be located on and fixed for rotation with first shaft 22 and may include a second peak region 68 and a second base circle region 70. The third cam lobe 30 may be located on and fixed for rotation with first shaft 22 and may include a third peak region 72 and a third base circle region 74. The second and third cam lobes 28, 30 may be rotationally fixed to the first shaft 22 with the first partial cam lobe 48 and the first base cam portion 50 located axially between the second and third cam lobes 28, 30.

The first partial cam lobe 48 and the first base cam portion 50 may be rotatable relative to first shaft 22, the second cam lobe 28 and the third cam lobe 30. The first partial cam lobe 48, the second cam lobe 28 and the third cam lobe 30 may each be engaged with the first valve lift mechanism 20*a*. While discussed as included both second and third cam lobes 28, 30, it is understood that alternate arrangements may include one of the second and third cam lobes 28, 30.

An outer circumferential region 76 of the camshaft 14 axially aligned with and radially opposite the first peak region 51 of the first partial cam lobe 48 may be radially offset from the first valve lift mechanism 20*a* when the second cam lobe 28 is engaged with the first valve lift mechanism 20*a*, and more specifically when the second peak region 68 is engaged with the first valve lift mechanism 20*a*. The outer circumferential region 76 on the camshaft 14 may correspond to the location of the first base cam portion 50. The first peak region 51 of the first partial cam lobe 48 may be rotationally offset from the second peak region 68 of the second cam lobe 28 and the third peak region 72 of the third cam lobe 30. The second and third peak regions 68, 72 may provide the radial offset between the outer circumferential region 76 of the camshaft 14 and the first valve lift mechanism 20*a*.

As discussed above, the first partial cam lobe 48 may be located radially relative to the second shaft 24 by the first sleeve 64. The first recess 53 may define a first stepped region 78 and the radial passage 43 may define a second stepped region 80. By way of non-limiting example, the first recess 53 may define a first portion 82 forming a threaded bore engaged with the fastener 32 and a second portion 84 located radially between the first portion 82 and the partial bore 52. The second portion 84 may define a diameter greater than a diameter of the first portion 82 to form the first stepped region 78.

The first sleeve 64 may abut the first stepped region 78 and the second stepped region 80 to radially locate the first partial cam lobe 48 relative to the second shaft 24. Since the first shaft 22 is located on the second shaft 24, the first sleeve 64 may also radially locate the first partial cam lobe 48 relative to the first shaft 22. The first sleeve 64 may provide a predetermined (or controlled) radial spacing between the outer circumference of second shaft 24 and the partial bore 52. This controlled spacing may therefore provide a controlled radial clearance between the partial bore 52 and the outer circumference of the first shaft 22.

Figure 4:
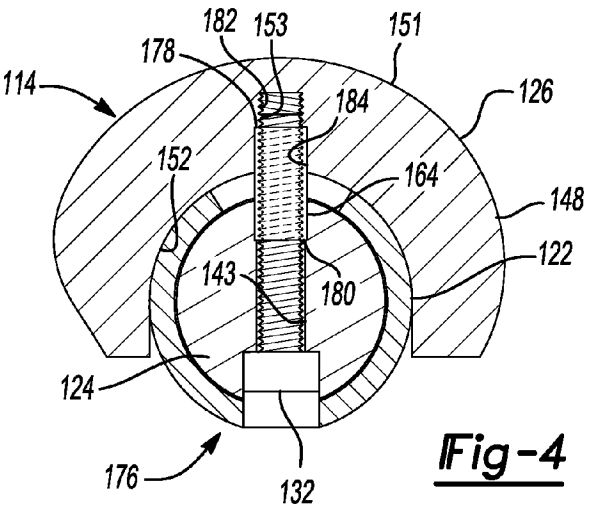
FIG. 4 is a section view of an alternate camshaft assembly according to the present disclosure.

In another arrangement, seen in FIG. 4, the first cam lobe 126 of the camshaft 114 may include the first partial cam lobe 148 (without the additional first base cam portion 50 seen in FIG. 3). The camshaft 114 may be generally similar to the camshaft 14, with the exceptions noted below. In the arrangement of FIG. 4, the fastener 132 may extend radially through the first shaft 122 and into the first partial cam lobe 148.

The camshaft 114 of FIG. 4 may also include an outer circumferential region 176 axially aligned with and radially opposite the first peak region 151 of the first partial cam lobe 148. The outer circumferential region 176 may be radially offset from the first valve lift mechanism (not shown) when the second cam lobe (not shown) is engaged with the first valve lift mechanism. The outer circumferential region 176 on the camshaft 114 may be defined on the first shaft 122.

Similar to the arrangement described above for FIG. 2, the first partial cam lobe 148 in FIG. 4 may be located radially relative to the second shaft 124 by the first sleeve 164. The first recess 153 may define a first stepped region 178 and the radial passage 143 may define a second stepped region 180. By way of non-limiting example, the first recess 153 may define a first portion 182 forming a threaded bore engaged with the fastener 132 and a second portion 184 located radially between the first portion 182 and the partial bore 152. The second portion 184 may define a diameter greater than a diameter of the first portion 182 to form the first stepped region 178.

The first sleeve 164 may abut the first stepped region 178 and the second stepped region 180 to radially locate the first partial cam lobe 148 relative to the second shaft 124. Since the first shaft 122 is located on the second shaft 124, the first sleeve 164 may also radially locate the first partial cam lobe 148 relative to the first shaft 122. The first sleeve 164 may provide a predetermined (or controlled) radial spacing between the outer circumference of second shaft 124 and the partial bore 152. This controlled spacing may therefore provide a controlled radial clearance between the partial bore 152 and the outer circumference of the first shaft 122.

During assembly, the first cam lobe 26, 126 may be secured to the camshaft 14, 114 after the second and third cam lobes 28, 30. More specifically, the camshaft 14, 114 may be machined after assembly of the second and third cam lobes 28, 30 and before the assembly of the first cam lobe 26, 126.

What is claimed is:

1. A camshaft comprising:

a first shaft defining an axial bore;

a second shaft located within the axial bore, rotatable relative to the first shaft and defining a radial passage;

a first partial cam lobe located on the first shaft and including a first peak region, the first partial cam lobe defining a partial bore and a first recess extending in a radial direction through the partial bore and into the first partial cam lobe, the partial bore having a circumferential extent from a first circumferential end of the first partial cam lobe to a second circumferential end of the first partial cam lobe, a radial distance defined by the partial bore between the first circumferential end and the second circumferential end being greater than or equal to a radial width of the first shaft;

a first sleeve located within the radial passage and the first recess and radially locating the first partial cam lobe relative to the second shaft;

a second cam lobe located on and fixed for rotation with the first shaft, the first partial cam lobe being rotatable relative to the first shaft and the second cam lobe; and a fastener extending radially through the second shaft, through the first sleeve, through a circumferentially extending slot in the first shaft and into the first partial cam lobe to fix the first partial cam lobe for rotation with the second shaft while allowing relative rotation between the first partial cam lobe and the first shaft.

2. A camshaft comprising:

a first shaft defining an axial bore;

a second shaft located within the axial bore, rotatable relative to the first shaft and defining a radial passage;

a first partial cam lobe located on the first shaft and including a first peak region, the first partial cam lobe defining a partial bore and a first recess extending in a radial direction through the partial bore and into the first partial cam lobe, the partial bore having a circumferential extent from a first circumferential end of the first partial cam lobe to a second circumferential end of the first partial cam lobe, a radial distance defined by the partial bore between the first circumferential end and the second circumferential end being greater than or equal to a radial width of the first shaft;

a first sleeve located within the radial passage and the first recess and radially locating the first partial cam lobe relative to the second shaft; and a first base cam portion located on the first shaft and axially aligned with and coupled to the first partial cam lobe and a fastener extending radially through the first base cam portion and the first shaft and into the first partial cam lobe.

3. A camshaft comprising:

a first shaft defining an axial bore;

a second shaft located within the axial bore, rotatable relative to the first shaft and defining a radial passage;

a first partial cam lobe located on the first shaft and including a first peak region, the first partial cam lobe defining a partial bore and a first recess extending in a radial direction through the partial bore and into the first partial cam lobe, the partial bore having a circumferential extent from a first circumferential end of the first partial cam lobe to a second circumferential end of the first partial cam lobe, a radial distance defined by the partial bore between the first circumferential end and the second circumferential end being greater than or equal to a radial width of the first shaft; and a first sleeve located within the radial passage and the first recess and radially locating the first partial cam lobe relative to the second shaft, wherein the radial passage defines a first stepped region and the first recess defines a second stepped region, the first stepped region facing the second stepped region and the first sleeve abutting the first stepped region and the second stepped region to radially locate the first partial cam lobe relative to the second shaft.

4. The camshaft of claim 3, further comprising a fastener including a threaded shank extending through the radial passage and the first sleeve and into the first recess, the first recess defining a first portion forming a threaded bore engaged with the fastener and second portion being located radially between the first portion and the partial bore and defining a diameter greater than a diameter of the first portion to form the second stepped region.

5. An engine assembly comprising:

an engine structure; and a camshaft rotationally supported on the engine structure and including:

a first shaft defining an axial bore;

a second shaft located within the axial bore, rotatable relative to the first shaft and defining a radial passage;

a first partial cam lobe located on the first shaft and including a first peak region, the first partial cam lobe defining a partial bore and a first recess extending in a radial direction through the partial bore and into the first partial cam lobe, the partial bore having a circumferential extent from a first circumferential end of the first partial cam lobe to a second circumferential end of the first partial cam lobe, a radial distance defined by the partial bore between the first circumferential end and the second circumferential end being greater than or equal to a radial width of the first shaft; and a first sleeve located within the radial passage and the first recess and radially locating the first partial cam lobe relative to the first shaft, wherein the camshaft includes a second cam lobe located on and fixed for rotation with first shaft, the first partial cam lobe being rotatable relative to first shaft and the second cam lobe; and a cam phaser coupled to the camshaft, the camshaft including a second shaft located within and rotatable relative to the first shaft and a fastener extending radially through the second shaft, through the first sleeve, through a circumferentially extending slot in the first shaft and into the first partial cam lobe to fix the first partial cam lobe for rotation with the second shaft while allowing relative rotation between the first partial cam lobe and the first shaft.

6. An engine assembly comprising:

an engine structure; and a camshaft rotationally supported on the engine structure and including:

a first shaft defining an axial bore;

a second shaft located within the axial bore, rotatable relative to the first shaft and defining a radial passage;

a first partial cam lobe located on the first shaft and including a first peak region, the first partial cam lobe defining a partial bore and a first recess extending in a radial direction through the partial bore and into the first partial cam lobe, the partial bore having a circumferential extent from a first circumferential end of the first partial cam lobe to a second circumferential end of the first partial cam lobe, a radial distance defined by the partial bore between the first circumferential end and the second circumferential end being greater than or equal to a radial width of the first shaft; and a first sleeve located within the radial passage and the first recess and radially locating the first partial cam lobe relative to the first shaft;

wherein the camshaft includes a first base cam portion located on the first shaft and axially aligned with and coupled to the first partial cam lobe and a fastener extending radially through the first base cam portion and the first shaft and into the first partial cam lobe.

7. An engine assembly comprising:

an engine structure; and a camshaft rotationally supported on the engine structure and including:

a first shaft defining an axial bore;

a second shaft located within the axial bore, rotatable relative to the first shaft and defining a radial passage;

a first partial cam lobe located on the first shaft and including a first peak region, the first partial cam lobe defining a partial bore and a first recess extending in a radial direction through the partial bore and into the first partial cam lobe, the partial bore having a circumferential extent from a first circumferential end of the first partial cam lobe to a second circumferential end of the first partial cam lobe, a radial distance defined by the partial bore between the first circumferential end and the second circumferential end being greater than or equal to a radial width of the first shaft; and a first sleeve located within the radial passage and the first recess and radially locating the first partial cam lobe relative to the first shaft;

wherein the radial passage defines a first stepped region and the first recess defines a second stepped region, the first stepped region facing the second stepped region and the first sleeve abutting the first stepped region and the second stepped region to radially locate the first partial cam lobe relative to the second shaft.

8. The engine assembly of claim 7, wherein the camshaft includes a fastener including a threaded shank extending through the radial passage and the first sleeve and into the first recess, the first recess defining a first portion forming a threaded bore engaged with the fastener and second portion being located radially between the first portion and the partial bore and defining a diameter greater than a diameter of the first portion to form the second stepped region.

* * * * *